US007045173B2

(12) United States Patent
Hirsch et al.

(10) Patent No.: US 7,045,173 B2
(45) Date of Patent: May 16, 2006

(54) COATING PROCESS FOR PRODUCING WEB FORM PRODUCTS INVOLVING APPLICATION OF ELECTROSTATIC CHARGES AND SUBSEQUENT CHARGE NEUTRALIZATION

(75) Inventors: Ralf Hirsch, Quickborn (DE); Sven Konig, Hamburg (DE); Dieter Muller, Kutenholz-Mulsum (DE); Hermann Neuhaus-Steinmetz, Ahrensburg (DE); Horst Wickborn, Hamburg (DE)

(73) Assignee: Tesa AG, Hamburg (DE)

( * ) Notice: Subject to any disclaimer, the term of this patent is extended or adjusted under 35 U.S.C. 154(b) by 0 days.

(21) Appl. No.: 10/495,883

(22) PCT Filed: Nov. 25, 2002

(86) PCT No.: PCT/EP02/13212

§ 371 (c)(1),
(2), (4) Date: Nov. 1, 2004

(87) PCT Pub. No.: WO03/045579

PCT Pub. Date: Jun. 5, 2003

(65) Prior Publication Data

US 2005/0084618 A1 Apr. 21, 2005

(30) Foreign Application Priority Data

Nov. 26, 2001 (DE) ..... 101 57 883

(51) Int. Cl.
*B05D 1/04* (2006.01)
*B05D 1/26* (2006.01)

(52) U.S. Cl. ..... 427/482; 427/483; 427/485; 427/207.1; 427/420

(58) Field of Classification Search ..... 427/458, 427/472, 356, 358, 533, 535, 536, 538, 420, 427/207.1, 208.2, 208.4, 482, 483, 485
See application file for complete search history.

(56) References Cited

U.S. PATENT DOCUMENTS

| | | | | |
|---|---|---|---|---|
| 3,196,063 | A | 7/1965 | Paquin et al. | 161/250 |
| 4,339,485 | A * | 7/1982 | Shibano et al. | 428/41.3 |
| 4,457,256 | A * | 7/1984 | Kisler et al. | 118/621 |
| 4,513,683 | A * | 4/1985 | Kisler | 118/620 |
| 4,622,260 | A | 11/1986 | Tesch | 428/173 |
| 4,748,043 | A | 5/1988 | Seaver et al. | 427/30 |
| 4,791,004 | A * | 12/1988 | Suzuki et al. | 427/541 |
| 4,835,004 | A | 5/1989 | Kawanishi | 427/13 |
| 4,997,600 | A | 3/1991 | Okumura et al. | 264/22 |
| 5,032,422 | A | 7/1991 | Lamirand et al. | 427/33 |
| 5,494,619 | A | 2/1996 | Zaretsky et al. | 264/466 |
| 6,120,278 | A | 9/2000 | Zimmermann et al. | 425/174.8 |
| 6,127,003 | A * | 10/2000 | Fukuda et al. | 427/535 |
| 6,475,572 | B1 * | 11/2002 | Louks et al. | 427/472 |

(Continued)

FOREIGN PATENT DOCUMENTS

DE 43 13 008 C1 11/1994

(Continued)

*Primary Examiner*—Fred J. Parker
(74) *Attorney, Agent, or Firm*—Norris McLaughlin & Marcus, P.A.

(57) ABSTRACT

A process for producing products in web form comprising at least two layers, in which a composition emerging from an applicator is applied as a layer to a substrate in web form which is guided on a transport means, the application taking place with application of electrostatic charges, and in which the substrate coated with the composition is electrostatically neutralized before departing the applicator, the transport means being provided with an electrically insulating coating.

36 Claims, 2 Drawing Sheets

U.S. PATENT DOCUMENTS 6,652,908 B1 11/2003 Guldbrandsen et al. .. 427/208.8

FOREIGN PATENT DOCUMENTS

| | | | |
|---|---|---|---|
| DE | 199 05 935 | A1 | 8/2000 |
| EP | 0 071 212 | B1 | 4/1986 |
| EP | 0 299 492 | A2 | 1/1989 |
| EP | 0 578 151 | A1 | 1/1994 |
| EP | 0 707 940 | A2 | 4/1996 |
| EP | 0 764 521 | A2 | 3/1997 |
| EP | 0 764 521 | A3 | 3/1997 |
| EP | 0 920 973 | A2 | 6/1999 |
| EP | 0 920 973 | A3 | 6/1999 |

* cited by examiner

COATING PROCESS FOR PRODUCING WEB FORM PRODUCTS INVOLVING APPLICATION OF ELECTROSTATIC CHARGES AND SUBSEQUENT CHARGE NEUTRALIZATION

This application is a 371 of PCT/EP02/13212, filed Nov. 25, 2002, and claims priority under 35 USC §119 on the basis of German Application No. 101 57 883.0, filed Nov. 26, 2001.

The invention relates to a process for producing products in web form comprising at least two layers, especially adhesive tapes with a carrier material atop which an adhesive has been applied.

Work has long been ongoing on producing adhesive tapes without using solvents or at least on designing the coating operation and the downstream steps to be solvent-free. Corresponding products with films of adhesive based on synthetic rubbers are known. These products, however, cover only the lower-end performance range of adhesive tapes.

For a number of years it has also been possible to obtain solvent-free adhesives based on acrylate, which can be processed further as hotmelt adhesives for adhesive tapes. Normally, however, they do not match the shear strengths of acrylate compositions applied from solution. One important reason for this is that the viscosity of the compositions during processing must not become too high, since otherwise the operations of melting and of coating onto a carrier are too expensive from the economic standpoint. The viscosity is determined substantially by the length of the molecules. Relatively short chain molecules, however, result in poorer shear strengths. Even crosslinking of the adhesive following its application permits only limited improvement.

In the case of natural rubber adhesive systems, the melting operation can be avoided if success is achieved in mixing the components of the composition without solvent and if the hot composition is supplied directly to a coating system. Examples of suitable mixing units include extruders. In the course of mixing, however, the rubber must not be degraded any more than slightly, since otherwise the product properties are impaired.

In the case of acrylate systems, the melting operation can be avoided by removing the solvent or water from compositions polymerized in solvents or in water, the removal taking place inline for the purpose of coating. In an appropriate extruder, for example, solvents or water can be removed by way of vacuum zones.

For the application of high-viscosity compositions, slot dies are suitable. It is found that they are also suitable for high-viscosity adhering compositions as described above. However, above a relatively low web speed, air bubbles become included between the adhesive and the substrate, which is typically coated on a lay-on roller.

In order to reduce the formation of bubbles in the above task, the market recommends blowing dies, suction dies, and what are known as vacuum boxes. The aim of using these devices is to raise the force with which the composition is pressed against the substrate.

Known from film manufacture (for example, EP 0 920 973 A2) are wire, blade, and needle electrodes, disposed transverse to the web, with which electrical charges are applied to the composition that is to be laid on. By this means the composition is pressed by electrostatic forces against a metal roller. Furthermore, combinations of electrostatic forces and forces by air movement are also used (EP 0 707 940 A2).

For the above-described coating of substrates, the literature reports complex solutions, in which before being laid onto the chill roll the substrate is charged in multistage upstream processes, partially discharged by heating, and cooled, in order finally to obtain uniform charging of the substrate on the lay-on roller (for example, EP 0 299 492 A2).

The maximum level of charge on the substrate in these cases, however, is relatively low, since as early as on leaving the charging roller it is reduced until the air is no longer ionized, owing to the electrical field strength resulting from the charge density.

In film manufacture (see for example U.S. Pat. No. 4,997,600 A1) an insulation for rollers is known in which, before the film is laid on, electrical charges are applied to the insulator layer in order to increase the press-on forces when the film is laid onto the roller.

If no charges are applied to the insulated roller, then electrostatic press-on forces during laying-on are greatly attenuated as the insulator layer increases in thickness. With the required insulator thicknesses which are necessary for sufficient high-voltage resistance for the ceramic coatings indicated here, achievable bubble-free coating speeds are drastically lowered.

DE 199 05 935 A1 discloses a method of producing a coating of solvent-free pressure sensitive adhesive systems on substrates, especially release-coated substrates, in which the pressure sensitive adhesive system is applied in one or more layers to a rotating roller by means of an adhesive applicator, the pressure sensitive adhesive system on the roller is crosslinked in an exposure means by high-energy radiation, specifically by means of electron beams (EB), UV or IR radiation, and the roller is contacted with the substrate, so that the pressure sensitive adhesive system is transferred from the roller to the substrate, and where appropriate is rolled up.

Typical exposure means employed in the context of the embodiment of the method that is depicted in said patent include linear cathode systems, scanner systems, and multiple longitudinal cathode systems, where electron beam accelerators are concerned.

The acceleration voltages are situated in the range between 40 kV and 350 kV, preferably from 80 kV to 300 kV. The output doses range between 5 and 150 kGy, in particular from 20 to 90 kGy.

As UV crosslinking units it is possible in particular to employ two medium pressure mercury lamps each with an output of 120 W/cm or one medium pressure mercury lamp having an output of 240 W/cm. The doses set are preferably from 10 to 300 mJ/cm$^2$.

DE 199 05 935 A1 describes a method of producing a coating of solvent-free pressure sensitive adhesive systems on substrates, especially release-coated substrates, in which a fluid film is applied to a rotating roller by means of a fluid applicator, the pressure sensitive adhesive system is applied in one or more layers to the fluid film by means of an adhesive applicator, so that the fluid film is located between roller and pressure sensitive adhesive system, and the roller is contacted with the substrate, so that the pressure sensitive adhesive system is transferred from the roller to the substrate (release-coated or otherwise).

The contacting of the substrate takes place in particular by way of a second roller. Substrates used include papers, films, nonwovens, and release-coated materials such as release papers, films, and the like.

The second roller, also referred to as a contact roller, may have been provided with a rubber coating and is pressed against the roller with a linear pressure of preferably 50 to 500 N/mm, in particular from 100 to 200 N/mm. The contact roller preferably has a Shore hardness (A) of from 40 to 100, in particular a Shore hardness of from 60 to 80 shore (A). The substrate is preferably brought into contact with the roller in such a way that the speed of the roller surface coincides with that of the substrate. Where, however, it is intended that a reduction in thickness should take place along with the removal of the adhesive film, the substrate may also have a higher speed.

In one advantageous embodiment the roller is a steel roller, a chrome-plated steel roller, a rubber roller or a silicone rubber roller and/or is manufactured from elastic material. Furthermore, the roller may be smooth or may have a slightly structured surface.

The smooth roller may preferably have a chrome coating. Optionally, the chrome-coated steel roller may possess a high-gloss-polished surface with a roughness $R_z$<0.02 μm. The coating roller may also, however, be rubberized, preferably with a rubber hardness of from 40 to 100 shore (A), in particular with a hardness of from 60 to 80 shore (A). The roller coating may, in accordance with the prior art, comprise EPDM, Viton or silicone rubber, or other elastic materials.

It has also proven advantageous for the roller to be temperature-controllable, preferably in a range from −10° C. to 200° C., in particular from 2° C. to 50° C.

If substrates treated antiadhesively on one or both sides with very thin coats are coated, for the production of adhesive tapes, with an adhesive, then the release effect of the substrate, particularly with respect to acrylate adhesives, is impaired if the laying-on of the adhesive is assisted electrostatically with high-voltage electrodes.

It is an object of the invention to allow the substrate to be coated with compositions, especially compositions of high viscosity, such as are used for producing adhesive tapes or similar products, with the preferred use of a slot die, with sufficiently high web speeds. In the course of this operation, there should be no bubbles included between the composition coat and the substrate, no detriment to quality-critical properties of the product being produced, and no hazards arising for operating staff.

This object is achieved by means of a process as specified in the main claim. The subclaims describe advantageous embodiments of the process.

The invention accordingly provides a process for producing products in web form having at least two layers, in which a composition emerging from an application means is applied to a substrate in web form which is guided on a transport means, said application taking place with application of electrostatic charges, and in which the substrate coated with the composition is electrostatically neutralized before departing the transport means, the transport means being provided with an electrically insulating coating for reducing damage.

In a first preferred embodiment of the process the application means is configured as a die, particularly a slot die, two-manifold or multiple-manifold die or adaptor die.

The transport means is coated, preferably contactlessly, with the composition emerging from the die. The distance of the die from the transport means may be preferably from 0.01 to 60 mm, in particular from 1 to 30 mm.

With further preference, the transport means is designed as a lay-on roller, which additionally, in particular, is of a grounded and/or temperature-controllable design, i.e., preferably in a range of from −10° C. to 200° C., very preferably in a range of from 0° C. to 180° C., in particular from 2° C. to 50° C.

In order to be able to provide the composition with the charge according to the invention, the composition may be charged electrostatically by means of at least one charging electrode, called lay-on electrode below, which is located in particular above the transport means, preferably lay-on roller, and specifically in the region of the lay-on line of the composition coat. The coat is pressed onto the substrate with the aid of the charges.

With the lay-on electrode, charges—electrons, for example—are applied to one side of the composition. On the surface of the transport means, preferably lay-on roller, countercharges come about immediately. The resulting field causes a force to act on the composition plus substrate, which presses both coats onto the transport means, preferably lay-on roller.

Moreover, in one outstanding embodiment of the inventive concept, the substrate coated with the composition is electrostatically neutralized by means of at least one countercharging electrode prior to departing the transport means, preferably lay-on roller, said countercharging electrode very particularly being located over the transport means, preferably lay-on roller, in the region between the lay-on line of the composition coat and the take-off line of the coated substrate.

Accordingly, electrostatic discharges as a consequence of applying charges by the lay-on electrode can be prevented even before the coated substrate has departed the preferred lay-on roller, by applying countercharges of opposite polarity and appropriate size.

For fine tuning it is further advantageous to mount an active discharge means over the detachment line of the coated substrate from the preferred lay-on roller, in order to compensate process-related fluctuations over time and across the width of the web.

The countercharging electrode is preferably in the form of a wire electrode, blade electrode and/or needle electrode which is disposed transverse to the web.

Without adequate neutralization of the electrical charges applied to the web by the lay-on electrode(s), there may be a corona discharge between the lay-on roller and the underside of the substrate, which may adversely affect, in particular, anti-adhesive properties of the substrate.

Additionally, as a result of the corona discharge, charges of opposed polarity may be transported on the underside of the web as on the coating side. If such a web is subsequently neutralized with customary active or passive discharge means, the measurable electrical field is eliminated but afterward there are still very strong, equally high charges of opposed polarity on the two sides. If the electrical conductivity of the coats between the charges is low, there may be uncontrollable discharges in bales that have been wound up.

In order to subject the substrate to as little stress as possible, the substrate should then be placed onto the transport means, preferably lay-on roller, with a contact roller and/or removed from the transport means, preferably lay-on roller, with a take-off roller.

It is advantageous, additionally, to select a conductive elastic coating as the preferred roller with which the substrate is placed onto the preferably selected lay-on roller.

Where a conductive coating cannot be used for technical reasons associated with the process, it is advantageous to subject the roller jacket to electrostatic discharge in a region in which it is not covered by the substrate. Otherwise, with each turn the roller surface may pick up more and more electrical charges, until uncontrolled discharge phenomena occur.

It is also advantageous to dispose a baffle of electrically insulating material in the running direction of the web upstream of the lay-on electrode, thereby limiting the ion-enriched area in the region of the lay-on electrode on the die side. It is favorable, in addition, to mount a grounded, electrically conducting metal plate on the side of the baffle that faces away from the lay-on electrode. By means of the baffle, any corona discharge upstream of the lay-on line can be reduced markedly by the composition coat on the substrate.

Also of advantage is an arrangement in which not only one needle electrode is used as lay-on electrode but instead two, directly following one another in the web direction, the two electrodes being offset laterally by half a needle spacing, thereby pairing the capacity of the needle electrodes for high charging currents with a relatively uniform charge distribution. In this context it has been found advantageous to impose a smaller high voltage on the front electrode than on the rear electrode.

In another preferred embodiment of the invention, the substrate is electrostatically neutralized prior to coating.

In another preferred variant of the process of the invention, the composition on the substrate is crosslinked or polymerized before departing the transport means, preferably lay-on roller, in particular by means of electron beams, UV rays, visible light or thermally or else by means of a combination of said processes.

In another preferred embodiment of the process, the thickness of the coating is less than 300 μm, in particular between 20 and 200 μm, very particularly between 20 and 120 μm and/or does not deviate more than preferably ±20% from the average value, in particular not more than ±5%, over the entire substrate-contact surface of the transport means.

It is also very advantageous if the coating has a low roughness and/or antiadhesive properties.

A particularly advantageous measure is to effect electrostatic neutralization of the coating in an area in which it is not covered by the substrate before it becomes covered by the substrate. Otherwise, with each revolution, it may pick up electrical charges more and more until uncontrolled discharge phenomena occur. However, even relatively minor uncontrolled charging, especially if it occurs nonuniformly, has an adverse effect on the formation of bubbles between coating and substrate.

In one outstanding embodiment, the coating is composed of polyester, TEFLON (polytetrafluoroethylene), CAPTON (polyimide), silicone rubber, polypropylene, casting resin or other materials which have sufficient high-voltage resistance at low coat thickness.

As a coating it is possible, for example, to use a shrink sleeve, which is pulled over the transport means, especially a lay-on roller, and shrunk.

Also outstandingly suitable is an insulator-coated, electrically conductive sleeve which is pulled over the transport means, especially lay-on roller.

In one preferred variant of the process the coating is applied in excess, is cured where appropriate, is additionally removed subsequently down to a desired, highly constant layer thickness, and then, finally, is polished for low roughness.

Examples that may be mentioned of possible embodiments of the coating include PET films of different thicknesses, and also applications of casting resin, preferably with thicknesses of between 20 μm and 300 μm and in particular with thicknesses of between 20 μm and 120 μm.

Another preferred variant is constituted by an electrically conductive conveyor belt which is coated with an electrical insulator and on which the substrate, for the purpose of coating, is guided over a lay-on roller; it being possible for the coating to have thicknesses of preferably between 20 μm and 300 μm and in particular between 20 μm and 120 μm.

Another preferred variant is a thin conveyor belt comprising an electrical insulator, preferably with thicknesses of between 20 μm and 300 μm and in particular with thicknesses of between 20 μm and 120 μm, on which the substrate, for the purpose of coating, is guided over a lay-on roller.

Another preferred variant is a modification wherein an auxiliary sheet, inserted between the electrically conductive transport means and the substrate following unwinding from a bale, is wound to a bale again after the coated substrate has been removed from the auxiliary sheet.

The process can be used to outstanding effect in those applications where the substrate is a release liner for an adhesive tape and/or the composition is an adhesive.

In this case the composition used may also comprise acrylic, natural rubber, synthetic rubber or EVA adhesives.

The process can likewise be used to outstanding effect in those applications where the substrate is a preliminary product comprising release liner, adhesive composition and carrier for a double-sided adhesive tape and the composition is an adhesive.

Furthermore, it is found that the tendency to form bubbles between the composition and the substrate increases if the substrate has become charged in an uncontrolled manner prior to placement onto the lay-on roller. It is also a problem if electrostatic discharge means are not mounted on the side of the web on which charging can take place as a result of separation events. In this case as well, no electrical field is measured any longer from the outside, but nevertheless there are equally strong electrical charges of opposed polarity on both sides of the web. The level of these double charges typically fluctuates in the web direction and also transversely to the web. These undefined double charges reduce the maximum speed at which the web can be effectively and safely run in a production process.

In one advantageous embodiment, discharge means are always mounted on the side at which charges occur as a result of separation events. With electrostatically difficult substrates, it may in extreme cases be of advantage to mount suitable discharge means behind each deflecting roller on the contact side and even in the winding nip at the unwind stage.

Moreover, it is advantageous to run the supplied bales with the substrate under electrostatic control as early as in the upstream process, or to select a sufficiently long interim storage period, due to sufficient electrical residual conductivities, for double charges to flow together. The time required may also be shortened by means of storage at elevated temperatures.

It is particularly advantageous to mount a baffle made of electrically insulating material in the running direction of the web between the applicator and the lay-on electrode, thereby bordering the ion-filled area in the region of the lay-on electrode by the applicator, especially die, the transport means, especially lay-on roller, and the baffle.

It is also possible for the coating to be composed of one or more layers and/or for the substrate to be composed of one or more layers, it being advantageous to produce multilayer coatings using multiple-manifold or adaptor dies.

It is also very advantageous if, using adaptors in the case of a single-manifold die or using a triple-manifold die, a coating composed of a first adhesive, a carrier, and a second adhesive is extruded and the substrate is a release liner.

Unexpectedly for the skilled worker, the inventive process offers a solution to the problems posed. Thus, coating with a slot die onto a substrate at sufficiently high web speeds is made possible without the development of bubbles between the composition coat and the substrate, without adverse effects on other, quality-critical properties of the product to be produced, in particular separating properties of release liners, and without special risks to the operating staff.

Surprisingly it has been found that bubbles are formed between the composition coat and the substrate particularly when there is air between the substrate and the lay-on roller. If the substrate was placed onto the lay-on roller in a bubble-free manner, it was possible to carry out coating with a higher web speed without the formation of bubbles. The appearance of the coating is much more uniform than in the case of a coating operation in which the substrate was not placed bubble-free on the lay-on roller during the production process.

Moreover, it is possible to ascertain, unexpectedly, that the formation of bubbles between the composition coat and the substrate is greatly reduced if the substrate is electrostatically neutralized in the web region upstream of the lay-on roller, very preferably on the side at which a charge accumulation occurs as a result of charge separation events.

With further preference, the substrate present on the transport means can be crosslinked, between the lay-on electrode and discharge electrode, by means of high-energy radiation supplied by an irradiation means, specifically by means of electron beams (EB), UV or IR rays. This is especially advantageous when the substrate in question is an adhesive.

Typical exposure means employed in the context of the inventive embodiment of the process are linear cathode systems, scanner systems, or multiple longitudinal cathode systems, where electron beam accelerators are concerned.

The acceleration voltages are situated preferably in the range between 40 kV and 500 kV, in particular between 80 kV and 300 kV. The output doses range between 5 and 150 kGy, in particular from 15 to 90 kGy.

As UV crosslinking units it is possible in particular to employ one or more medium pressure mercury lamps each with an output of up to 240 W/cm per lamp. The doses set are preferably from 10 to 300 mJ/cm$^2$.

For crosslinking or polymerization with visible light, halogen lamps may be employed in particular.

As substrate it is also possible to use release liners with anti-adhesive coatings to which the adhesion of adhesives is low. The backing materials of release liners are typically composed of paper or plastics, such as PET, PP or else PE, for example. The plastics used generally have good electrical insulation properties and high electrical breakdown field strengths.

In the case of papers, in contrast, the electrical properties are determined substantially by the thin anti-adhesive coating, but also by the impregnation and the moisture content. When the composition is applied with assistance by electrostatic charging, greater importance attaches to the electrical properties of the applied composition. Although the compositions employed are usually electrical insulators, their residual conductivity at typical coating temperatures of 100° C. or more is often already sufficiently high for some of the applied charges to flow off through the composition and through the paper release liner into the lay-on roller before departing the roller. Since at the lay-on line, if the electrical conductivity is not too high, virtually all of the charge is still present on the composition coat, it is nevertheless possible to achieve sufficiently high pressing forces for bubble-free coating. In the subsequent electrical neutralization by the application of countercharges, however, it must be borne in mind that some of the charge has already flowed off. At low web speeds, the time available for the charges to flow off becomes greater, and proportionally more charge flows off before the detachment line is reached. The optimum level of the countercharges is therefore dependent on the web speed.

For reasons of both economics and processing, the release coatings used for release liners are as thin as possible. Use is also made of what have been dubbed "substituted-covering coatings". By this is meant that the carrier is not hidden 100% by the release coating. It has been found that neutralization of the coated substrate in the case of such release liners must be carried out with substantially greater precision than is the case, say, with PET or PP films with fully hiding silicone coatings of 1.5 g/m$^2$ or more.

In the cases of double-sided adhesive tapes, a distinction is made between the open side and the hidden side of the release liner. The hidden side of the release liner, after being unwound from the roll, is covered with the assembly comprising first adhesive film, carrier, and second adhesive film. For undisrupted further processing after coating and until application, the release forces from the adhesive on the open side should be less than or equal to, and at least not substantially greater than, release forces on the hidden side, since otherwise there may be a reorientation of the release liner to the other side.

Graded release liners are also available. With these, it can be ensured that the hidden side has much higher release forces.

In the case of non-graded release liners, in particular, damage to the open side when producing a double-sided adhesive tape must only be relatively low, since the desire is to avoid replacement by an undamaged release liner.

For the production of double-sided adhesive tapes, the substrate may also be composed of the initial product from the first operation, namely of a release liner, an adhesive film, and the carrier.

As substrate or carrier material it is possible to use all known textile carriers such as wovens, knits, lays or nonwoven webs; the term "web" embraces at least textile sheetlike structures in accordance with EN 29092 (1988) and also stitchbonded nonwovens and similar systems.

It is likewise possible to use spacer fabrics, including wovens and knits, with lamination. Spacer fabrics of this kind are disclosed in EP 0 071 212 B1. Spacer fabrics are matlike layer structures comprising a cover layer of a fiber or filament fleece, an underlayer and individual retaining fibers or bundles of such fibers between these layers, said fibers being distributed over the area of the layer structure, being needled through the particle layer, and joining the cover layer and the underlayer to one another. As an additional though not mandatory feature, the retaining fibers in accordance with EP 0 071 212 B1 comprise inert mineral particles, such as sand, gravel or the like, for example.

The holding fibers needled through the particle layer hold the cover layer and the underlayer at a distance from one another and are joined to the cover layer and the underlayer.

Spacer wovens or spacer knits are described, inter alia, in two articles, namely an article from the journal kettenwirk-praxis 3/93, 1993, pages 59 to 63, "Raschelgewirkte Abstandsgewirke" [Raschel-knitted spacer knits] and an article from the journal kettenwirk-praxis 1/94, 1994, pages 73 to 76, "Raschelgewirkte Abstandsgewirke", the content of said articles being included here by reference and being part of this disclosure and invention.

Knitted fabrics are produced from one or more threads or thread systems by intermeshing (interlooping), in contrast to woven fabrics, which are produced by intersecting two thread systems (warp and weft threads), and nonwovens (bonded fiber fabrics), where a loose fiber web is consolidated by heat, needling or stitching or by means of water jets.

Knitted fabrics can be divided into weft knits, in which the threads run in transverse direction through the textile, and warp knits, where the threads run lengthwise through the textile. As a result of their mesh structure, knitted fabrics are fundamentally pliant, conforming textiles, since the meshes are able to stretch lengthways and widthways, and have a tendency to return to their original position. In high-grade material, they are very robust.

Suitable nonwovens include, in particular, consolidated staple fiber webs, but also filament webs, meltblown webs, and spunbonded webs, which generally require additional consolidation. Known consolidation methods for webs are mechanical, thermal, and chemical consolidation. Whereas with mechanical consolidations the fibers can be held together purely mechanically by entanglement of the individual fibers, by the interlooping of fiber bundles or by the stitching-in of additional threads, it is possible by thermal and by chemical techniques to obtain adhesive (with binder) or cohesive (binderless) fiber-fiber bonds. Given appropriate formulation and an appropriate process regime, these bonds may be restricted exclusively, or at least predominantly, to the fiber nodal points, so that a stable, three-dimensional network is formed while retaining the loose open structure in the web.

Webs which have proven particularly advantageous are those consolidated in particular by overstitching with separate threads or by interlooping.

Consolidated webs of this kind are produced, for example, on stitchbonding machines of the "Malifleece" type from the company Karl Meyer, formerly Malimo, and can be obtained, inter alia, from the companies Naue Fasertechnik and Techtex GmbH. A Malifleece is characterized in that a cross-laid web is consolidated by the formation of loops from fibers of the web.

The carrier used may also be a web of the Kunit or Multiknit type. A Kunit web is characterized in that it originates from the processing of a longitudinally oriented fiber web to form a sheetlike structure which has the heads and legs of loops on one side and, on the other, loop feet or pile fiber folds, but possesses neither threads nor prefabricated sheetlike structures. A web of this kind has been produced, inter alia, for many years, for example on stitchbonding machines of the "Kunitvlies" type from the company Karl Mayer. A further characterizing feature of this web is that, as a longitudinal-fiber web, it is able to absorb high tensile forces in the longitudinal direction. The characteristic feature of a Multiknit web relative to the Kunit is that the web is consolidated on both the top and bottom sides by virtue of the double-sided needle punching.

Finally, stitchbonded webs are also suitable as an intermediate forming an adhesive tape. A stitchbonded web is formed from a nonwoven material having a large number of stitches extending parallel to one another. These stitches are brought about by the incorporation, by stitching or knitting, of continuous textile threads. For this type of web, stitchbonding machines of the "Maliwatt" type from the company Karl Mayer, formerly Malimo, are known.

Also particularly advantageous is a staple fiber web which is mechanically preconsolidated in the first step or is a wet-laid web laid hydrodynamically, in which between 2% and 50% of the web fibers are fusible fibers, in particular between 5% and 40% of the fibers of the web.

A web of this kind is characterized in that the fibers are laid wet or, for example, a staple fiber web is preconsolidated by the formation of loops from fibers of the web or by needling, stitching or air-jet and/or water-jet treatment.

In a second step, thermofixing takes place, with the strength of the web being increased again by the (partial) melting of the fusible fibers.

The web carrier may also be consolidated without binders, by means for example of hot embossing with structured rollers, with properties such as strength, thickness, density, flexibility, and the like being controllable via the pressure, temperature, residence time, and embossing geometry.

For the use of nonwovens, the adhesive consolidation of mechanically preconsolidated or wet-laid webs is of particular interest, it being possible for said consolidation to take place by way of the addition of binder in solid, liquid, foamed or pastelike form. A great diversity of theoretical embodiments is possible: for example, solid binders as powders for trickling in; as a sheet or as a mesh, or in the form of binding fibers. Liquid binders may be applied as solutions in water or organic solvent or as a dispersion. For adhesive consolidation, binder dispersions are predominantly chosen: thermosets in the form of phenolic or melamine resin dispersions, elastomers as dispersions of natural or synthetic rubbers, or, usually, dispersions of thermoplastics such as acrylates, vinyl acetates, polyurethanes, styrene-butadiene systems, PVC, and the like, and also copolymers thereof. Normally, the dispersions are anionically or nonionically stabilized, although in certain cases cationic dispersions may also be of advantage.

The binder may be applied in a manner which is in accordance with the prior art and for which it is possible to consult, for example, standard works of coating or of nonwoven technology such as "Vliesstoffe" (Georg Thieme Verlag, Stuttgart, 1982) or "Textiltechnik-Vliesstofferzeugung" (Arbeitgeberkreis Gesamttextil, Eschborn, 1996).

For mechanically preconsolidated webs which already possess sufficient composite strength, the single-sided spray application of a binder is appropriate for effecting specific changes in the surface properties.

Such a procedure is not only sparing in its use of binder but also greatly reduces the energy requirement for drying. Since no squeeze rollers are required and the dispersion remains predominantly in the upper region of the web material, unwanted hardening and stiffening of the web can very largely be avoided.

For sufficient adhesive consolidation of the web carrier, the addition of binder in the order of magnitude of from 1% to 50%, in particular from 3% to 20%, based on the weight of fiber web, is generally required.

The binder may be added as early as during the manufacture of the web, in the course of mechanical preconsolidation, or else in a separate process step, which may be carried out in-line or off-line. Following the addition of the binder it is necessary temporarily to generate a condition in which the binder becomes adhesive and adhesively connects the fibers—this may be achieved during the drying, for example, of dispersions, or else by heating, with further possibilities for variation existing by way of areal or partial application of pressure. The binder may be activated in known drying tunnels, or else, given an appropriate selection of binder, by means of infrared radiation, UV radiation, ultrasound, high-frequency radiation or the like. For the subsequent end use it is sensible, although not absolutely necessary, for the binder to have lost its tack following the end of the web production process. It is advantageous that, as a result of the thermal treatment, volatile components such as fiber assistants are removed, giving a web having favorable fogging values so that when a low-fogging adhesive is used it is possible to produce an adhesive tape having particularly advantageous fogging values.

A further, special form of adhesive consolidation consists in activating the binder by incipient dissolution or swelling. In this case it is also possible in principle for the fibers themselves, or admixed special fibers, to take over the function of the binder. Since, however, such solvents are objectionable on environmental grounds, and/or are problematic in their handling, for the majority of polymeric fibers, this process is not often employed.

Starting materials envisaged for the textile carrier include, in particular, polyester, polypropylene, viscose or cotton fibers. The selection is, however, not restricted to said materials; rather it is possible to use a large number of other fibers to produce the web, this being evident to the skilled worker without any need for inventive activity.

Carrier materials used further include, in particular, laminates and nets, and also films (for example, a polyolefin from the group of the polyethylenes (for example, HDPE, LDPE, MDPE, LLDPE, VLLDPE, copolymers of ethylene with polar comonomers) and/or the group of the polypropylenes (for example, polypropylene homopolymers, random polypropylene copolymers or block polypropylene copolymers), monoaxially or biaxially oriented polypropylene, polyesters, PVC, PET, polystyrene, polyamide or polyimide), foams, foam material, of polyethylene and polyurethane, for example, foamed films, and creped and uncreped paper. Moreover, these materials may have been given a pretreatment and/or an aftertreatment. Common pretreatments are corona irradiation, impregnation, coating, painting, and hydrophobicization; customary aftertreatments are calendering, thermal conditioning, lamination, die cutting, and enveloping.

Low flammability in the carrier material and in the adhesive tape as a whole may be achieved by adding flame retardants to the carrier and/or to the adhesive. These retardants may be organobromine compounds, together where appropriate with synergists such as antimony trioxide; however, with a view to the absence of halogens from the adhesive tape, preference will be given to using red phosphorus, organophosphorus compounds, mineral compounds or intumescent compounds such as ammonium polyphosphate, alone or in conjunction with synergists.

As adhesives it is possible to use substantially all known adhesives possessing sufficient bond strength to the bond substrate that is to be packed.

The adhesive of the adhesive tape may be composed of an adhesive based on solventborne natural rubber adhesives and acrylic adhesives. Preference is given to adhesives based on acrylic dispersions; adhesives based on styrene-isoprene-styrene block copolymers are particularly preferred. These adhesive technologies are known and are used in the adhesive tape industry.

The coatweight of the adhesive on the carrier material is preferably from 15 to 60 g/m$^2$. In a further preferred embodiment, the coatweight set is from 20 to 30 g/m$^2$.

The adhesive tapes can be produced by known methods. An overview of customary production methods can be found, for example, in "Coating Equipment", Donatas Satas in Handbook of Pressure Sensitive Adhesive Technology, second edition, edited by Donatas Satas, Van Nostrand Reinhold New York pp. 767–808. The known methods of drying and slitting the adhesive tapes are likewise to be found in the Handbook of Pressure Sensitive Adhesive Technology, pp. 809–874.

A suitable adhesive composition is one based on acrylic hotmelt, having a K value of at least 20, in particular more than 30 (measured in each case in 1% strength by weight solution in toluene at 25° C.), obtainable by concentrating a solution of such a composition to give a system which can be processed as a hotmelt.

Concentrating may take place in appropriately equipped vessels or extruders; particularly in the case of accompanying devolatilization, a devolatilizing extruder is preferred.

An adhesive of this kind is set out in DE 43 13 008 C2. In an intermediate step, the solvent is removed completely from the acrylate compositions prepared in this way.

The K value is determined in particular in analogy to DIN 53 726.

In addition, further volatile constituents are removed. After coating from the melt, these compositions contain only small fractions of volatile constituents. Accordingly, it is possible to adopt all of the monomers/formulations claimed in the above-cited patent. A further advantage of the compositions described in the patent is that they have a high K value and thus a high molecular weight. The skilled worker is aware that systems with higher molecular weights may be crosslinked more efficiently. Accordingly, there is a corresponding reduction in the fraction of volatile constituents.

The solution of the composition may contain from 5 to 80% by weight, in particular from 30 to 70% by weight, of solvent.

It is preferred to use commercially customary solvents, especially low-boiling hydrocarbons, ketones, alcohols and/or esters.

Preference is further given to using single-screw, twin-screw or multiscrew extruders having one or, in particular, two or more devolatilizing units.

The adhesive based on acrylic hotmelt may contain copolymerized benzoin derivatives, such as benzoin acrylate or benzoin methacrylate, for example, acrylates or methacrylates. Benzoin derivatives of this kind are described in EP 0 578 151 A.

The adhesive based on acrylic hotmelt may be UV-crosslinked. Other types of crosslinking, however, are also possible, an example being electron beam crosslinking.

In one particularly preferred embodiment, self-adhesive compositions used comprise copolymers of (meth)acrylic acid and esters thereof having from 1 to 25 carbon atoms, maleic, fumaric and/or itaconic acid and/or esters thereof, substituted (meth)acrylamides, maleic anhydride, and other vinyl compounds, such as vinyl esters, especially vinyl acetate, vinyl alcohols and/or vinyl ethers.

The residual solvent content should be below 1% by weight.

It is also possible to use an adhesive from the group of the natural rubbers or the synthetic rubbers or any desired blend of natural and/or synthetic rubbers, the natural rubber or rubbers being selectable in principle from all available grades such as, for example, crepe, RSS, ADS, TSR or CV grades, depending on required purity and viscosity, and the synthetic rubber or rubbers being selectable from the group of randomly copolymerized styrene-butadiene rubbers (SBR), butadiene rubbers (BR), synthetic polyisoprenes (IR), butyl rubbers (IIR), halogenated butyl rubbers (XIIR), acrylic rubbers (ACM), ethylene-vinyl acetate (EVA) copolymers and polyurethanes and/or blends thereof.

Furthermore, and preferably, the processing properties of the rubbers may be improved by adding to them thermoplastic elastomers with a weight fraction of from 10 to 50% by weight, based on the total elastomer fraction.

As representatives, mention may be made at this point, in particular, of the particularly compatible styrene-isoprene-styrene (SIS) and styrene-butadiene-styrene (SBS) types.

As tackifying resins it is possible without exception to use all known tackifier resins which have been described in the literature. Representatives that may be mentioned include the rosins, their disproportionated, hydrogenated, polymerized, esterified derivatives and salts, the aliphatic and aromatic hydrocarbon resins, terpene resins, and terpene-phenolic resins. Any desired combinations of these and other resins may be used in order to adjust the properties of the resulting adhesive in accordance with what is desired. Explicit reference is made to the depiction of the state of the art in the "Handbook of Pressure Sensitive Adhesive Technology" by Donatas Satas (van Nostrand, 1989).

"Hydrocarbon resin" is a collective term for thermoplastic polymers which are colorless to intense brown in color and have a molar mass of generally <2000.

They may be divided into three main groups according to their provenance: petroleum resins, coal tar resins, and terpene resins. The most important coal tar resins are the coumarone-indene resins. The hydrocarbon resins are obtained by polymerizing the unsaturated compounds that can be isolated from the raw materials.

Included among the hydrocarbon resins are also polymers obtainable by polymerizing monomers such as styrene and/or by means of polycondensation (certain formaldehyde resins), with a correspondingly low molar mass. Hydrocarbon resins are products with a softening range that varies within wide limits from <0° C. (hydrocarbon resins liquid at 20° C.) to >200° C. and with a density of from about 0.9 to 1.2 g/cm$^3$.

They are soluble in organic solvents such as ethers, esters, ketones, and chlorinated hydrocarbons, and are insoluble in alcohols and water.

By rosin is meant a natural resin which is recovered from the crude resin from conifers.

Three types of rosin are differentiated: balsam resin, as a distillation residue of turpentine oil; root resin, as the extract from conifer root stocks; and tall resin, the distillation residue of tall oil. The most significant in terms of quantity is balsam resin.

Rosin is a brittle, transparent product with a color ranging from red to brown. It is insoluble in water but soluble in many organic solvents such as (chlorinated) aliphatic and aromatic hydrocarbons, esters, ethers, and ketones, and also in plant oils and mineral oils. The softening point of rosin is situated within the range from approximately 70 to 80° C.

Rosin is a mixture of about 90% resin acids and 10% neutral substances (fatty acid esters, terpene alcohols, and hydrocarbons). The principal rosin acids are unsaturated carboxylic acids of empirical formula $C_{20}H_{30}O_2$, abietic, neoabietic, levopimaric, pimaric, isopimaric, and palustric acid, as well as hydrogenated and dehydrogenated abietic acid. The proportions of these acids vary depending on the provenance of the rosin.

Plasticizers which can be used are all plasticizing substances known from adhesive tape technology. They include, inter alia, the paraffinic and naphthenic oils, (functionalized) oligomers such as oligobutadienes and oligoisoprenes, liquid nitrile rubbers, liquid terpene resins, animal and vegetable oils and fats, phthalates, and functionalized acrylates.

For the purpose of heat-induced chemical crosslinking, it is possible to use all known heat-activatable chemical crosslinkers such as accelerated sulfur or sulfur donor systems, isocyanate systems, reactive melamine resins, formaldehyde resins, and (optionally halogenated) phenol-formaldehyde resins and/or reactive phenolic resin or diisocyanate crosslinking systems with the corresponding activators, epoxidized polyester resins and acrylic resins, and combinations thereof.

The crosslinkers are preferably activated at temperatures above 50° C., in particular at temperatures from 100° C. to 160° C., with very particular preference at temperatures from 110° C. to 140° C.

The thermal excitation of the crosslinkers may also be effected by means of IR rays or other high-energy electromagnetic alternating fields.

BRIEF DESCRIPTION OF THE DRAWINGS

With reference to the figures described below, particularly advantageous embodiments of the invention are illustrated, without wishing to be unnecessarily restricted by the choice of the figures shown.

Accordingly, FIG. 1 shows a device in which an adhesive 8 is placed onto a substrate 7. That is, it shows a process for producing adhesive tapes.

Figure 1:
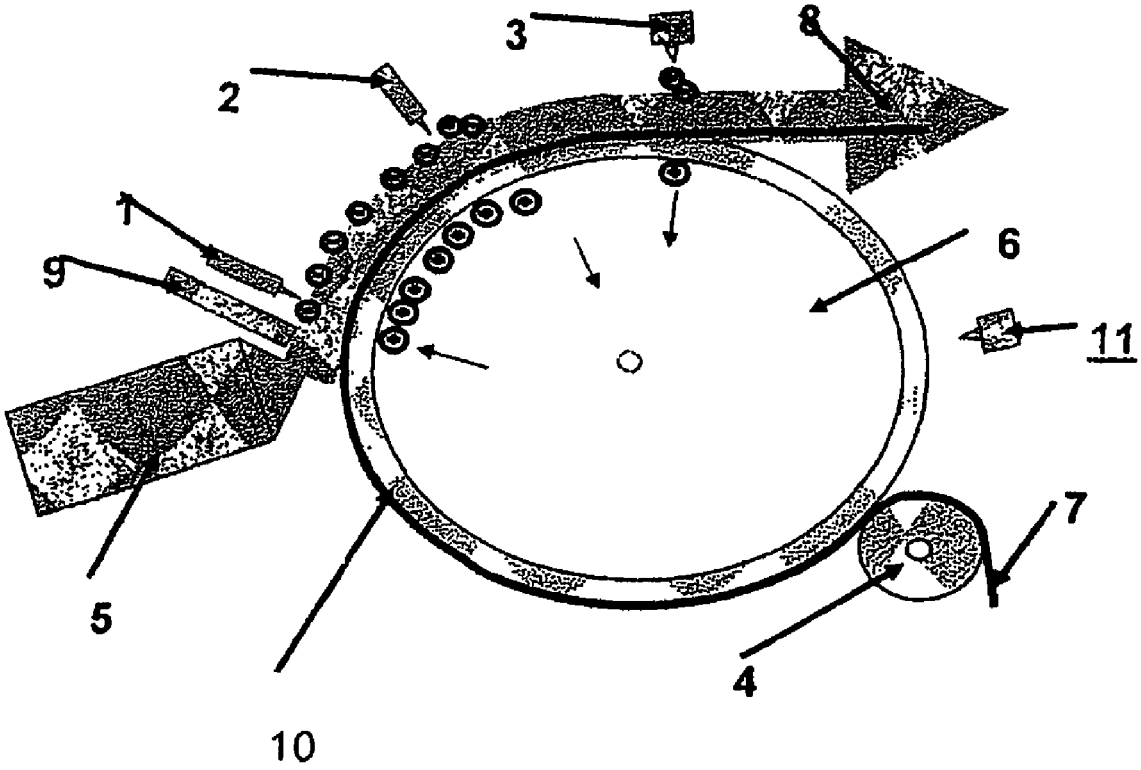
FIG. 1 shows the process of the invention in one particularly advantageous embodiment.

The device has a lay-on roller 6 with a thin electrically insulating coating 10. In this case, a grounded chill roll is used. The substrate 7 is a release liner, consisting of a monoaxially oriented polypropylene film provided on both sides with anti-adhesive silicone layers. The coating 10 is intended to reduce damage to the antiadhesive silicone layers caused by the electrostatic laying-on.

The substrate 7 is placed onto the lay-on roller 6 with an electrically insulating coating 10 via a contact roller 4, thereby removing the air between substrate 7 and lay-on roller 6. Finally, via the coating die 5, the composition 8, in this case an adhesive, is applied, this operation being carried out under the lay-on electrode 1.

Here, with the lay-on electrode 1, ions are applied to one side of the composition 8. Countercharges immediately develop below the electrically insulating coating 10 of the lay-on roller 6. The resulting field causes a force to act on the composition plus substrate, this force pressing both layers onto the lay-on roller 6.

After it has traversed the countercharging electrode 2 and the discharge electrode 3, the substrate 7 coated with the composition 8 is removed from the lay-on roller 6.

The countercharging electrode 2 brings opposite charges, such as the charging electrode, to the composition 8, so that the charges largely neutralize each other.

At the discharge electrode 3, finally, the last charges on the composition 8 are removed.

The baffle 9 upstream of the lay-on electrode 1 bounds the ion-enriched space.

The lay-on roller 6 is provided with an insulating coating 10, in this case a PET casting resin.

The discharge electrode 11 is intended to prevent charging of the insulator coat 10.

Figure 2:
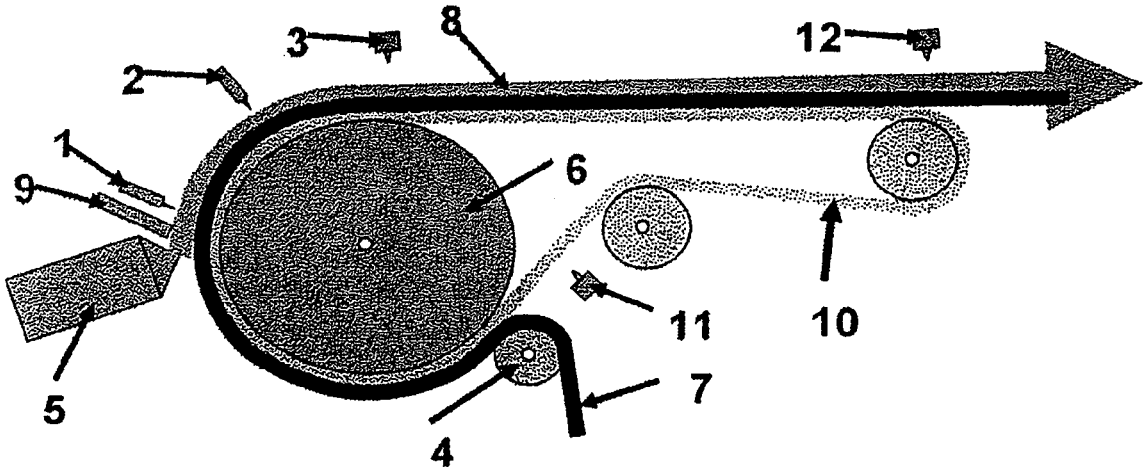
FIG. 2 shows the process of the invention in a second particularly advantageous embodiment.

FIG. 2 shows a device in which an adhesive 8 is placed onto a substrate 7. That is, it shows a process for producing adhesive tapes.

The device has a lay-on roller 6, over which there runs an electrically conductive conveyor belt 10 with a thin, electrically insulating coating. A grounded chill roll is used. The substrate 7 is a release liner, consisting of a release paper provided on both sides with antiadhesive silicone layers. The conveyor belt 10 with an electrically insulating coating is intended to reduce the damage to the antiadhesive silicone layers caused by the electrostatic laying-on.

The substrate 7 is placed onto the lay-on roller 6 via a contact roller 4, with the conveyor belt 10 between them. Finally, via the coating die 5, the composition 8, in this case an adhesive, is applied, this operation being carried out under the lay-on electrode 1.

Here, with the lay-on electrode 1, ions are applied to one side of the composition 8. Countercharges immediately develop under the electrically insulating coating of the conveyor belt 10 which is grounded by way of the lay-on roller. The resulting field causes a force to act on the composition plus substrate, this force pressing both layers onto the conveyor belt 10.

After it has traversed the countercharging electrode 2 and the discharge electrode 3, the substrate 7 coated with the composition 8 is removed from the lay-on roller 6.

The countercharging electrode 2 applies opposite charges to the composition 8, with the consequence that the charges neutralize one another to a substantial extent.

At the discharge electrode 3, finally, the last charges on the composition 8 are removed.

The baffle 9 upstream of the lay-on electron 1 bounds the ion-enriched space.

The purpose of the discharge electrode 11 is to prevent charging of the insulator coat of the conveyor belt 10.

The discharge electrode 12 prevents damage to the silicone layers when the coated substrate is removed.

EXAMPLES

Example 1

An acrylic adhesive was polymerized in solvents and concentrated in an extruder. In a further extruder, resins, aging inhibitors, and other additives were admixed. Coating of the composition took place via a melt pump through a slot die (from Extrusion Dies Inc., USA) with a coating width of 35 cm onto a polypropylene release film, 70 μm thick, with which the coating was laid using a contact roller onto a temperature-controllable lay-on roller. In a downstream laminating station, a BOPP film 50 μm thick was laminated onto the coated side of the first film, which had been provided on both sides with 0.5 g/m$^2$ antiadhesive silicone layers. The laminate was then wound up.

In order to charge the composition coat the lay-on electrode used was a needle electrode (type R130A from Eltex) which was supplied from a high-voltage generator (type KNH34/N from Eltex). Additionally, a second, identical needle electrode (countercharging electrode) was mounted in the region between the lay-on line of the composition and the take-off line of the coated substrate from the lay-on roller, and supplied by a further high-voltage generator (type KNH34/P from Eltex) with high voltage of opposite polarity. The lay-on electrode was loaded with a negative high voltage of −15.8 kV for a web speed of 75 m/min. The distance of the needle tips from the roller surface, the position of the electrode in the running direction of the web, and the angle of inclination of the electrode to the tangent of the lay-on roller were optimized until bubbles were no longer observed between composition and substrate. At that point the needle distance was about 5 mm from the roller surface, the position of the electrode was about 8 mm behind the lay-on point in the running direction of the web, and the angle of inclination to the tangent of the lay-on roller was 90°.

The countercharging electrode was supplied with an opposed, i.e., positive, high voltage of +13.7 kV, so that the absolute value of the electrode current was equal to that of the lay-on electrode and the coated substrate was therefore electrostatically neutralized before departing the roller. The distance of the needle tips of the countercharging electrode from the roller surface was about 12 mm.

Above the line of detachment of the web from the lay-on roller, however, there was also an active discharge electrode (type R51A from Eltex) fed with 8 kV oscillating current at a frequency of 50 Hz from a power supply (Eltec type: ES52).

The aim of the experiment, with a coating speed of 85 m/min and an application rate of 85 g/m$^2$, was to reduce the damage to the antiadhesive properties of the release film that was found with the above experimental setup, without observation of bubbles between composition and substrate.

The formation of bubbles was determined in line using a camcorder, a strong light source, and a monitor, with the aid of status pictures at exposure times of between 100 and 1 000 microseconds, and also by the inspection of samples after the web had been halted.

Subsequently, the lay-on roller was wrapped with one ply in each case of polyester films of different thickness. At the seam there was overlap between the beginning and end of the film. The beginning was fixed to the roll cylinder using an adhesive film, and the end was fixed correspondingly to the beginning of the film. For all of the films, bubbles occurred at the seams between composition and substrate at much lower web speeds than in the remaining region.

The wraps of film, however, tended toward uncontrolled electrostatic charging. In the region not covered by the substrate, between the take-off line of the coated substrate from the lay-on roller and the contact roller, therefore, an active discharge electrode (type R51A from Eltex) was mounted.

The following web speeds could be reached, without bubbles, with different thicknesses of film wraps:

| | |
|---|---|
| 190 μm PET film | 40 m/min |
| 75 μm PET film | 75 m/min |
| 50 μm PET film | 85 m/min |
| 25 μm PET film | 85 m/min |

Subsequently, the damage to the antiadhesive properties of the release film was determined at the experimental settings of 50 μm PET film and 85 m/min, and also at the same speed without covering the lay-on roller with film. In this case it was ensured that the seams were not included in the results.

The damage was determined by the following measurement method.

Measurement of the Release Force

A double-sided test adhesive tape is applied without bubbles to that side of the release liner that is to be measured, and is pressed on by rolling over it five times with a 2 kg steel roller. The assembly is then stored in a hot chamber at 70° C. for one week. In order to measure the peel force (release force), the test tape side facing the release liner is fastened to a steel rail. The release liner bonded to the test adhesive tape is then peeled off at an angle of 180° and a speed of 300 mm/min. The tensile force (in cN/cm) required to achieve this is measured on a tensile testing machine under standardized conditions (23° C., 50% atmospheric humidity).

The values reported are the minimum, the maximum, and the average of five individual measurements.

Release Forces Measured by the Method Indicated

| | Minimum | Maximum | Average |
|---|---|---|---|
| Undamaged reference sample | 8 cN/cm | 10 cN/cm | 9 cN/cm |
| Exposed side of the release film Lay-on roller not covered | 17 cN/cm | 30 cN/cm | 24 cN/cm |
| Lined side of the release film Lay-on roller not covered | 14 cN/cm | 20 cN/cm | 17 cN/cm |
| Exposed side of the release film Lay-on roller covered with 50 μm PET | 15 cN/cm | 23 cN/cm | 19 cN/cm |
| Lined side of the release film Lay-on roller covered with 50 μm PET | 13 cN/cm | 17 cN/cm | 15 cN/cm |

The results show that when the roller is wrapped with an electrical insulator the release film was damaged to a lesser extent. Wrapping of the lay-on roller with relatively thick films, however, reduces the web speed which can be achieved without bubbles.

Example 2

In this experiment, the same setup as in example 1 was chosen. However, the substrate was guided on a conveyor belt over the lay-on roller. An additional active discharge electrode was mounted over the take-off line of the coated substrate from the conveyor belt, and the discharge electrode for the roller wrap was moved, so that it pointed toward the substrate-facing side of the conveyor belt.

Used first was a nonconductive belt cloth with woven reinforcement, which was 3 mm thick and already existed on the coating unit. A web speed of only 20 m/min without bubbles between coating and substrate was achieved. At higher speeds, in particular, the woven structure in the belt, despite a smooth surface to the substrate, was reproduced in the pattern of the bubbles between coating and substrate.

Thereafter, instead of the existing belt cloth, the same PET films as in experiment 1 were used. They were guided over the same deflector rollers, tensioning rollers, and web-edge control system as the belt.

In terms of the achievable bubble-free web speed and the damage to the release film, the results of the experiment are identical within the bounds of measurement accuracy.

Example 3

In this experiment, the same setup as in example 1 was chosen. Instead of the wrapping of the lay-on roller with a film, the lay-on roller was given a bubble-free coating of a PET casting resin. The coating was applied in excess. In a following operation, the coating was removed to a thickness of 100 μm, with an accuracy of ±3 μm, and polished.

At this relatively high roller-coating thickness (see example 1) a bubble-free web speed of 70 m/min was attained. As in the case of the roller wraps, damage to the release film was reduced.

The following values were achieved by the measurement method specified in example 1:

| | Minimum | Maximum | Average |
|---|---|---|---|
| Undamaged reference sample | 7 cN/cm | 11 cN/cm | 9 cN/cm |
| Exposed side of the release film | 15 cN/cm | 22 cN/cm | 18 cN/cm |
| Lined side of the release film | 14 cN/cm | 18 cN/cm | 16 cN/cm |

Within the bounds of measurement accuracy, these values correspond to those with 50 μm PET film wrap in example 1.

What is claimed is:

1. A process for prod acing a product in web form, said product comprising at least two layers, said process comprising applying a composition emerging from an applicator as a layer to a substrate in web form guided over a lay-on roller said applying taking place with an application of electrostatic charges, and electrostatically neutralizing the substrate coated with the composition before the coated substrate departs the lay-on roller, the lay-on roller being provided with an electrically insulating coating.

2. The process as claimed in claim 1, wherein said applicator is configured as a die.

3. The process as claimed in claim 1, wherein the composition is electrostatically charged by means of at least one lay-on electrode.

4. The process as claimed in claim 1, wherein as a lay-on electrode two needle electrodes arranged directly following one another in the web direction are used.

5. The process as claimed in claim 1, wherein the substrate coated with the composition is electrostatically neutralized by means of at least one countercharging electrode before departing the lay-on roller.

6. The process as claimed in claim 1, wherein the substrate coated with the composition is kept electrostatically neutral by means of at least one discharge electrode on departing the lay-on roller.

7. The process as claimed in claim 1, wherein the electrically insulating coating of the lay-on roller is electrostatically neutralized by means of at least one discharge electrode upstream of a lay-on line of the substrate onto the lay-on roller.

8. The process as claimed in claim 1, wherein the substrate is placed with a contact roller onto the lay-on roller and/or is removed from the lay-on roller with a take-off roller.

9. The process as claimed in claim 1, wherein a baffle made of electrically insulating material is mounted in a running direction of a web between an applicator and a lay-on electrode.

10. The process as claimed in claim 1, wherein the substrate is electrostatically neutralized prior to coating.

11. The process as claimed in claim 1, wherein the composition on the substrate is crosslinked before departing the lay-on roller.

12. The process as claimed in claim 1, wherein the thickness of the coating is less than 300 μm and/or the thickness deviates by not more than ±20% from the average value over the entire surface of the lay-on roller.

13. The process as claimed in claim 1, wherein the electrically insulating coating has antiadhesive properties.

14. The process as claimed in claim 1, wherein the electrically insulating coating is composed of polyester, polytetrafluoroethylene, polyimide, silicone rubber, polypropylene, or casting resin.

15. The process as claimed in claim 1, wherein the electrically insulating coating used is a shrink sleeve which is pulled over the lay-on roller and shrunk.

16. The process as claimed in claim 1, wherein a conductive sleeve with an insulating coating is pulled over the lay-on roller.

17. The process as claimed in claim 1, wherein the substrate is guided over the lay-on roller on an electrically conductive conveyor belt which is coated with an electrical insulator.

18. The process as claimed in claim 1, wherein the substrate is guided over said lay-on roller on a conveyor belt composed of an electrical insulator.

19. The process as claimed in claim 1, wherein the substrate is guided over a conductive transport means on a electrically insulating auxiliary sheet which is unwound from a bale, and the auxiliary sheet is subsequently wound up into a bale again.

20. The process as claimed in claim 1, wherein the substrate is a release liner for an adhesive tape and/or the composition is an adhesive.

21. The process as claimed in claim 1, wherein the substrate is an initial product consisting of release liner, adhesive, and carrier for a double-sided adhesive tape and the composition is an adhesive.

22. The process as claimed in claim 1, wherein the substrate is a release liner and the coating, consisting of a first adhesive, carrier, and a second adhesive, is applied from a triple-manifold or adaptor die.

23. The process as claimed in claim 1, wherein said composition comprises acrylic, natural rubber, synthetic rubber or EVA adhesives.

24. The process as claimed in claim 2, wherein the die is a slot die, a two-manifold die, a multiple-manifold die or an adaptor die.

25. The process as claimed in claim 1, wherein the lay-on roller is grounded and/or temperature-controllable.

26. The process as claimed in claim 3, wherein the at least one lay-on electrode is located above the lay-on roller in the region of a lay-on line of the composition coating.

27. The process as claimed in claim 4, wherein the needle electrodes are laterally offset by half the length of a needle.

28. The process as claimed in claim 5, wherein the at least one counter charging electrode is located over the lay-on roller in a region between a lay-on line of the composition coat and a take-off line of the coated substrate.

29. The process as claimed in claim 6, wherein the discharge electrode is located over the lay-on roller in a region of a take-off line of the coated substrate.

30. The process as claimed in claim 11, wherein the composition on the substrate is crosslinked by at least one crosslinking method selected from the group consisting of electron beams, UV rays, visible light and thermally.

31. The process as claimed in claim 12, wherein the thickness of the coating is between 30 μm and 200 μm and/or the thickness deviates by not more than ±5% over the entire surface of the lay-on roller.

32. The process as claimed in claim 31, wherein the thickness of the coating is between 40 μm and 120 μm.

33. The process as claimed in claim 18, wherein the conveyor belt has a thickness between 20 μm and 300 μm.

34. The process as claimed in claim 33, wherein the conveyor belt has a thickness between 20 μm and 120 μm.

35. The process as claimed in claim 19, wherein the auxiliary sheet has a thickness between 20 μm and 300 μm.

36. The process as claimed in claim 35, wherein the auxiliary sheet has a thickness between 20 μm and 120 μm.

* * * * *